US010818464B2

(12) United States Patent
Huang et al.

(10) Patent No.: US 10,818,464 B2
(45) Date of Patent: Oct. 27, 2020

(54) EXTERNAL GRID-CONTROLLED HOT CATHODE ARRAY ELECTRON GUN

(71) Applicants: Nuctech Company Limited, Beijing (CN); Tsinghua University, Beijing (CN)

(72) Inventors: Wenhui Huang, Beijing (CN); Qingxiu Jin, Beijing (CN); Cong Xu, Beijing (CN); Luming Zhang, Beijing (CN); Donghai Liu, Beijing (CN); Cheng Song, Beijing (CN); Peidong Wu, Beijing (CN); Qun Luo, Beijing (CN); Chengjun Tan, Beijing (CN); Shuo Wang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 0 days.

(21) Appl. No.: 16/728,783

(22) Filed: Dec. 27, 2019

(65) Prior Publication Data

US 2020/0211806 A1 Jul. 2, 2020

(30) Foreign Application Priority Data

Dec. 28, 2018 (CN) ..... 2018 1 1631854

(51) Int. Cl.
*H01J 3/02* (2006.01)

(52) U.S. Cl.
CPC ..... *H01J 3/024* (2013.01)

(58) Field of Classification Search
CPC ..... H01J 3/024
See application file for complete search history.

(56) References Cited

U.S. PATENT DOCUMENTS

2002/0191947 A1* 12/2002 Takeuchi ..... G02B 26/02 385/147
2007/0132357 A1* 6/2007 Wells ..... H01J 3/024 313/310
2008/0191607 A1* 8/2008 Kawai ..... C09K 11/586 313/503

* cited by examiner

*Primary Examiner* — Kevin Quarterman
(74) *Attorney, Agent, or Firm* — Knobbe, Martens, Olson & Bear, LLP

(57) ABSTRACT

An external grid-controlled hot cathode array electron gun, including an insulated cathode base, a filament, a plurality of hot cathode emission elements, and a grid-controlled structure is disclosed. In one aspect, the grid-controlled structure includes an insulated grid-controlled structure body and a plurality of through holes. One side of the grid-controlled structure body abuts against the cathode base to clamp the filament between the grid-controlled structure body and the cathode base and the plurality of hot cathode emission elements are inserted into the plurality of through holes respectively.

10 Claims, 3 Drawing Sheets

EXTERNAL GRID-CONTROLLED HOT CATHODE ARRAY ELECTRON GUN

CROSS-REFERENCE TO RELATED APPLICATION

This application claims priority to Chinese Patent Application No. 201811631854.4 filed on Dec. 28, 2018 in the National Intellectual Property Administration of China, the disclosure of which is hereby incorporated herein by reference in its entirety.

TECHNICAL FIELD

The disclosed technology relates to an external grid-controlled hot cathode array electron gun.

BACKGROUND

Thermal electron emission relies on raising temperature of an object to provide additional energy to electrons inside the object, allowing some high-energy electrons to escape across the barrier of a surface of the object. A hot cathode electron gun is mainly divided into a directly heating type hot cathode electron gun and an indirectly heating type hot cathode electron gun depending on the heating ways. In the indirectly heating type hot cathode electron gun, a filament is not in contact with an emission source, and heat is transferred to the emission source through a heat medium. In the directly heating type hot cathode electron gun, a filament and an emission source are in direct contact with each other.

For a radiation source device that requires multiple electron sources, there is a need to provide an array type electron gun which can achieve effective control of an electron beam.

SUMMARY

According to an aspect of the disclosed technology, there is provided an external grid-controlled hot cathode array electron gun, including: an insulated cathode base; a filament, the filament being in form of a strip and mounted on a surface of the cathode base; a plurality of hot cathode emission elements mounted on a surface of the filament facing away from the cathode base; and a grid-controlled structure comprising an insulated grid-controlled structure body and a plurality of through holes provided in the grid-controlled structure body, one side of the grid-controlled structure body abutting against the cathode base so that the filament is held between the grid-controlled structure body and the cathode base, and so that the plurality of hot cathode emission elements on the surface of the filament are inserted into the plurality of through holes, respectively.

In an embodiment of the disclosed technology, the grid-controlled structure further comprises a plurality of grid-controlled switches, and each of said plurality of grid controlled switches is mounted to an end of one of the plurality of through holes of the grid-controlled structure body such that the plurality of grid-controlled switches are capable of controlling the plurality of hot cathode emission element.

In an embodiment of the disclosed technology, each of the grid-controlled switches further comprises a gridding element, a Kovar ring, and a balancer ring and a lead wire; the grid-controlled structure body is provided with a recessed groove at an end of the through hole away from the hot cathode emission elements, an inner diameter of the Kovar ring is greater than an inner diameter of the through hole, and the Kovar ring is received in the recessed groove such that an end surface of the Kovar ring is conformed and jointed to a bottom surface of the recessed groove and an outer wall surface of the Kovar ring is conformed and jointed to an inner wall surface of the recessed groove; the gridding element is accommodated in the Kovar ring and is jointed to the bottom surface of the recessed groove, and the balancer ring is received in the Kovar ring and abuts against the gridding element so as to clamp the gridding element between the balancer ring and the bottom surface of the recessed groove; the lead wire is connected to the Kovar ring.

In an embodiment of the disclosed technology, the grid-controlled structure body is provided with a first lead wire hole matching the lead wire and the cathode base is provided with a second lead wire hole matching the lead wire, one end of the lead wire is connected to the Kovar ring, and the other end sequentially passes through the first lead wire hole and the second lead wire hole to extend to a side of the cathode base facing away from the hot cathode emission elements.

In an embodiment of the disclosed technology, each of the grid-controlled switches further comprises a stop member, wherein the Kovar ring and the balancer ring are respectively provided with a first position-limit hole portion and a second position-limit hole portion, which are disposed in pair, in a circumferential direction thereof at a junction between the Kovar ring and the balancer ring, the first position-limit hole portion is located at an outer circumference of the Kovar ring, the second position-limit hole portion is located at an inner circumference of the balancer ring, and the first position-limit hole portion and the second position-limit hole portion, which are disposed in pair, together define a position-limit circular hole; and, the grid-controlled structure main body is provided with a mounting hole corresponding to the position-limit circular hole, so that the stop member is inserted into the position-limit circular hole and the mounting hole to fix the Kovar ring and the balancer ring.

In an embodiment of the disclosed technology, the cathode base comprises a through groove, and the filament is mounted to the through groove, a width of the through groove is not less than a width of the filament, and a depth of the through groove is greater than a thickness of the filament; and the grid-controlled structure body includes a projection that cooperates with the through groove to clamp the filament therebetween.

In an embodiment of the disclosed technology, the cathode base comprises a plurality of ridges, a space is defined between every adjacent two of the ridges and the through groove is formed on a top side of each of the plurality of ridges.

In an embodiment of the disclosed technology, a reflective layer is provided, between adjacent two of the ridges, on a surface of the cathode base.

In an embodiment of the disclosed technology, the filament is in a shape of a U, and includes a filament body portion sandwiched between the cathode base and the grid-controlled structure body and a filament folded portion extending along two end faces of the cathode base, the two end faces of the cathode base being perpendicular to the surface of the cathode base on which the filament is mounted.

In an embodiment of the disclosed technology, the filament has a width ranged from 1 mm to 2 mm and a thickness ranged from 0.03 mm. 0.05 mm.

The above various embodiments of the disclosed technology provide an aspect, providing an external grid-controlled hot cathode array electron gun, including: an insulated cathode base; a filament, the filament being in form of a strip and mounted on a surface of the cathode base; a plurality of hot cathode emission elements mounted on a surface, facing away from the cathode base, of the filament; a grid-controlled structure comprising an insulated grid-controlled structure body and a plurality of through holes disposed in the grid-controlled structure body; one side of the grid-controlled structure body abuts against the cathode base to clamp the filament between the grid-controlled structure body and the cathode base and the plurality of hot cathode emission elements on the surface of the filament are inserted into the plurality of through holes respectively. The external grid-controlled hot cathode array electron gun of the disclosed technology may be provided with increased or decreased number of electron gun arrays as required, can realize splicing of multiple sets of electron gun arrays, can flexibly meet the needs of radiation source devices requiring multiple electron sources, and have advantages such as a simple manufacturing process, good consistency, fast startup and a long life.

Description of the disclosed technology by referring the drawings below will make other objects and advantages of the disclosed technology be apparent and be favor of complete understanding of the disclosed technology.

DETAILED DESCRIPTION

Figure 1:
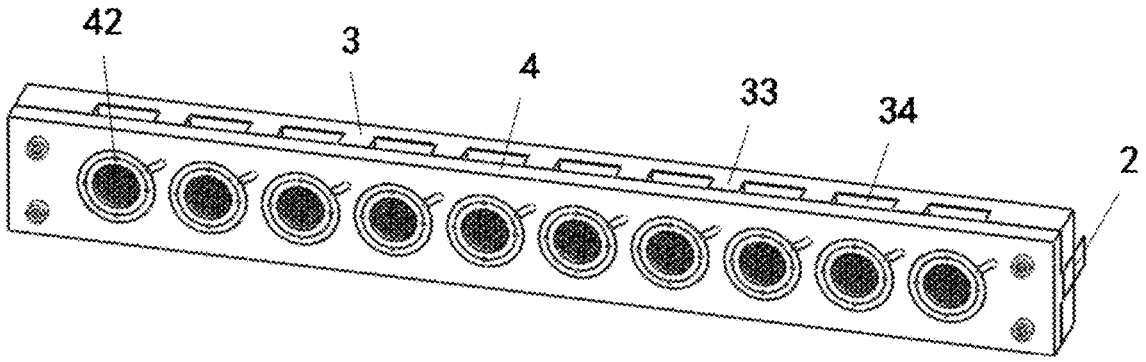
FIG. 1 shows a perspective view of an external grid-controlled hot cathode array electron gun according to an embodiment of the disclosed technology.

The technical solutions of the disclosed technology will be further specifically described below by way of embodiments and with reference to the accompanying drawings. In the description, the same or similar reference numerals indicate the same or similar parts. The description of the embodiments of the disclosed technology made with reference to the accompanying drawings is intended to illustrate the general inventive concept of the disclosure, and should not be construed as a limitation of the disclosure.

In the following detailed description, numerous specific details are set forth for convenient of interpretation so as to understand the embodiments of the disclosed technology. It may be appreciated that one or more embodiments may be practiced without these specific details. Additionally, structures and devices may be shown diagrammatically in the drawings.

According to the disclosed technology, there is provided an external grid-controlled hot cathode array electron gun, which includes: an insulated cathode base; a filament in form of a strip, mounted on a surface of the cathode base; a plurality of hot cathode emission elements mounted on a surface of the filament facing away from the cathode base; and a grid-controlled structure comprising an insulated grid-controlled structure body and a plurality of through holes disposed in the grid-controlled structure body; wherein a side of the grid-controlled structure body abuts against the cathode base such that the filament is held or clamped between the grid-controlled structure body and the cathode base and that the plurality of hot cathode emission elements on the surface of the filament are inserted into the plurality of through holes respectively.

Figure 2:
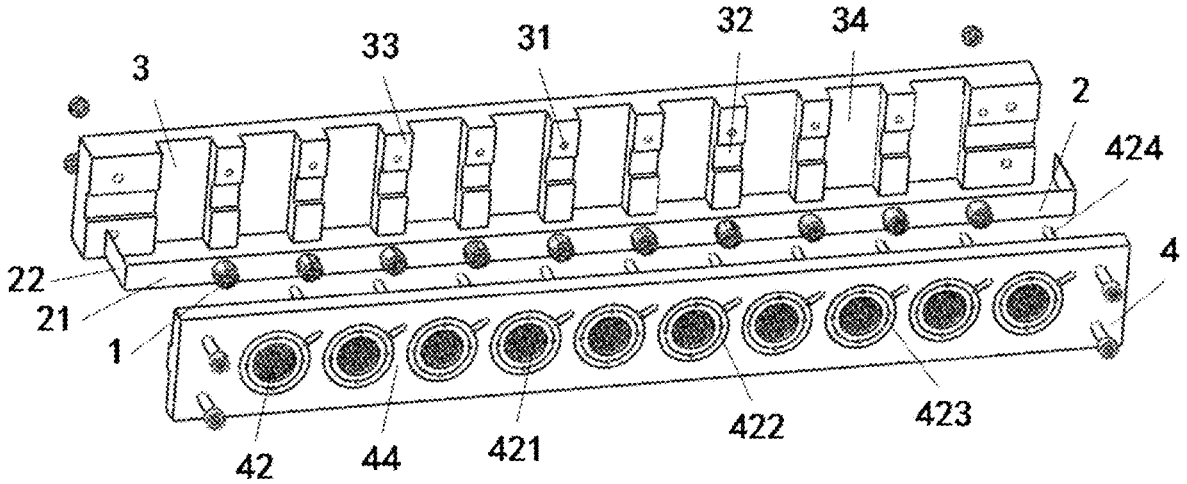
FIG. 2 shows an exploded view of an external grid-controlled hot cathode array electron gun according to an embodiment of the disclosed technology.
Figure 3:
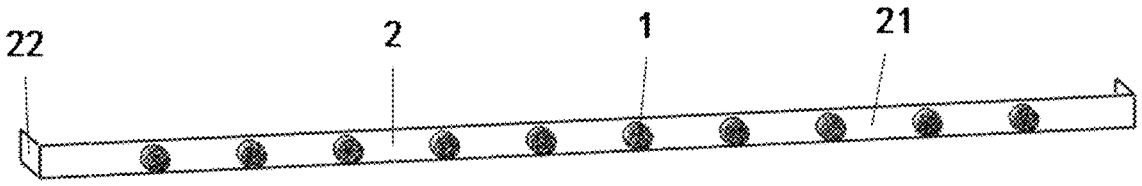
FIG. 3 is a perspective view showing a cathode base and a filament according to an embodiment of the disclosed technology.
Figure 4:
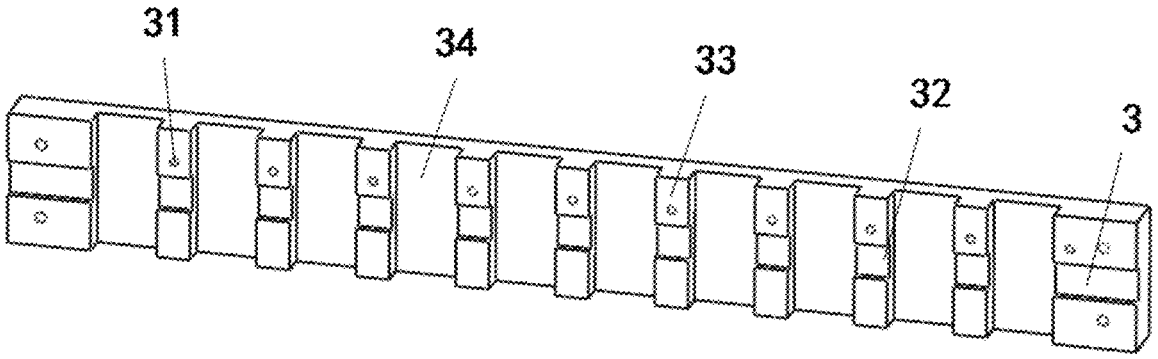
FIG. 4 is a perspective view showing a cathode base according to an embodiment of the disclosed technology.
Figure 5:
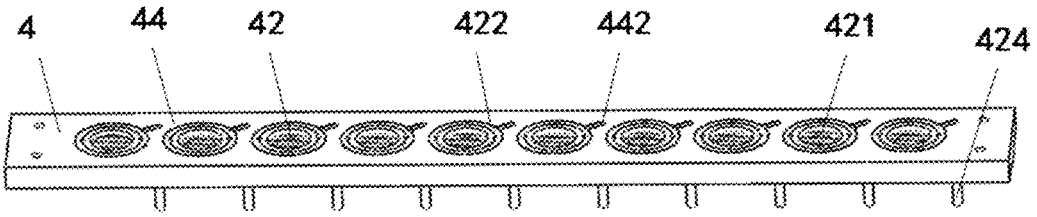
FIG. 5 is a perspective view showing a grid-controlled structure according to an embodiment of the disclosed technology.
Figure 6:
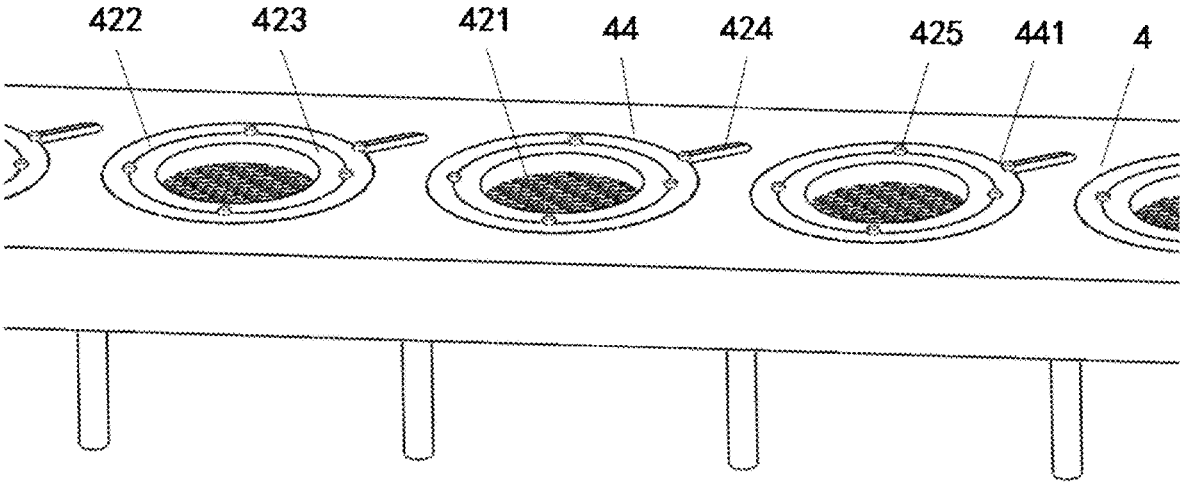
FIG. 6 is a partially enlarged schematic view of the grid-controlled structure shown in FIG. 5.

FIG. 1 shows a perspective view of an external grid-controlled hot cathode array electron gun according to an embodiment of the disclosed technology; FIG. 2 shows an exploded view of an external grid-controlled hot cathode array electron gun according to an embodiment of the disclosed technology; FIG. 3 is a perspective view showing a cathode base and a filament according to an embodiment of the disclosed technology; FIG. 4 is a perspective view showing a cathode base according to an embodiment of the disclosed technology; FIG. 5 is a perspective view showing a grid-controlled structure according to an embodiment of the disclosed technology; and FIG. 6 is a partially enlarged schematic view of the grid-controlled structure shown in FIG. 5.

In an exemplary embodiment of the disclosed technology, as shown in FIGS. 1 and 2, the external grid-controlled hot cathode array electron gun includes an insulated cathode base 3, a filament 2, a plurality of hot cathode emission elements 1 and a grid-controlled structure 4. The filament 2 is in form of a strip and is mounted on a surface of the cathode base 3. The plurality of hot cathode emission elements 1 are mounted on a surface of the filament 2 facing away from the cathode base 3. The grid-controlled structure 4 includes an insulated grid-controlled structure body 44 and a plurality of through holes provided in the grid-controlled structure body 44. One side of the grid-controlled structure body 44 abuts against the cathode base 3 so that the filament 2 is held or clamped between the grid-controlled structure body 44 and the cathode base 3 and that the plurality of hot cathode emission elements 1 on the surface of the filament 2 are inserted into the plurality of through holes respectively. In one embodiment, the hot cathode emission elements 1 may be made of a porous tungsten sponge structure, which is formed by processing tungsten powder by a process such as pressing, sintering or the like, and finally machining the processed product by a lathe, and then is formed as an electron-emitting source by impregnating the porous tungsten sponge structure with an electronically active substance, for example, barium aluminate. The hot cathode emission elements 1 are generally of a columnar structure and may each have a cross section that may be designed into a circular, elliptical, square or polygonal shape as required, and have a height ranged from 1 mm to 1.2 mm and a diameter ranged from 1 mm to 3 mm. In the embodiment shown in FIG. 2, the number of the hot cathode emission elements 1 are ten, and each of the hot cathode emission elements 1 has a cylindrical profile. The number of the hot cathode emission elements 1 may be increased or decreased according to actual needs, and multiple sets of spliced hot cathode emission elements may be realized.

In another embodiment, as shown in FIGS. 2 and 3, the filament 2 is in form of a strip. The filament 2 is provided to heat the hot cathode emission elements 1, and is usually made of a metal having a high melting point and a high thermal conductivity. In one embodiment, the filament 2 is made of at least one of molybdenum (Mo), ruthenium (Ru), nickel (Ni), and tantalum (Ta). In one embodiment, the filament 2 has a width ranged from 1 mm to 2 mm and a thickness ranged from 0.03 mm to 0.05 mm. Dimensions of the filament 2 match those of the hot cathode emission elements 1 and depends on sizes and the number of the hot cathode emission elements 1. For example, a width of the filament 2 matches with that of the hot cathode emission element 1, and a length of the filament 2 is determined according to the number of the hot cathode emission elements 1, so that a sufficient installation space is reserved for the hot cathode emission elements 1 to ensure that the filament is in full contact with the hot cathode emission elements 1 and thus the filament can efficiently heat the hot cathode emission elements 1.

In the embodiments shown in FIGS. 2 and 3, the hot cathode emission elements 1 are distributed on a same surface of the filament 2 along the length of the filament 2, and the width of the filament 2 is equal to that of the hot cathode emission element 1. The hot cathode emission elements 1 are aligned with the filament 2 in the width direction of the filament 2, and an axis of each of the hot cathode emission elements 1 is perpendicular to the surface of the filament 2. Each of the hot cathode emission elements 1 directly abuts against and is sufficiently conformed and jointed to the surface of the filament 2. Each of the hot cathode emission elements 1 is fixedly attached to the surface of the filament 2. The hot cathode emission elements 1 can be fixed to the surface of the filament 2 by soldering.

In still another embodiment, the hot cathode emission elements 1 are evenly disposed on the surface of the filament 2 along the length direction of the filament 2. With this configuration, the filament 2 can uniformly heat each of the hot cathode emission elements 1 so that the respective hot cathode emission elements 1 have a same starting time, thereby obtaining a plurality of electron beams having good uniformity while preventing the hot cathode emission elements 1 from being damaged due to local overheating and thereby ensuring a long life of the hot cathode emission elements 1.

In an exemplary embodiment, a surface of the cathode base 3 facing the filament 2 is provided with a through groove 32, and the filament 2 is mounted in the through groove 32. A width of the through groove 32 is not less than the width of the filament 2, and the depth of the through groove 32 is greater than a thickness of the filament 2. Further, the grid-controlled structure 4 is provided with a projection on the surface facing the cathode base 3 to match the through groove 32. The projection is provided to match the through groove 32 to clamp the filament 2 therebetween. The through groove 32 may penetrate through the cathode base 3 along the length direction of the cathode base 3. The cathode base 3 is made of alumina ceramic and thereby has a good hardness, a high temperature resistance, good electrical insulation and heat insulation. The through groove 32 is used to position the filament 2 and cooperate with the grid-controlled structure 4. In order to obtain a better fixation of the filament 2 in the through groove 32, a bottom surface of the through groove 32 is matched with the surface of the filament 2 facing the through groove 32 so as to conform to the surface of the filament 2. In the embodiment as shown in FIG. 2, the cathode base 3 has a substantially rectangular parallelepiped profile, the filament 2 has a flat strip structure, and the bottom surface of the through groove 32 is thus also a corresponding plane, and the width of the through groove 32 is equal to the width of the filament 2. The width of the cathode base 3 is greater than the width of the through groove 32, and the through groove 32 is provided at an intermediate position on the surface of the cathode base 3 facing the filament 2. The through groove 32 is a rectangular through groove, and has a center line parallel to the length direction of the cathode base 3. The cathode base 3 and the grid-controlled structure 4 are tightly coupled together by cooperation between the protrusion and the through grooves 32 and then are further fixedly connected by a fastener such as a nut.

According to an embodiment of an aspect of the disclosure, as shown in FIGS. 2 and 3, the filament 2 is in the form of ⊓, which includes a filament body sandwiched between the cathode base 3 and the grid-controlled structure body 44, and filament folded portions 22 extending along both end faces of the cathode base 3, the end faces of the cathode base 3 being perpendicular to the surface of the cathode base 3 on which the filament 2 is mounted. The filament folded portions 22 may be conformed and jointed to the end faces of the cathode base 3. The filament body portion 21 is perpendicular to the filament folded portion 22.

Referring to FIGS. 2 and 4, in accordance with an embodiment of the disclosed technology, the cathode base 3 includes a plurality of ridges 33. A space is defined between adjacent ridges 33, and the through groove 32 is formed in the top side of plurality of ridges 33. The plurality of ridges 33 are disposed along the length direction of the cathode base 3 and on the surface of the cathode base 3 facing the filament 2. The depth of the through groove 32 is less than a height of the ridges 33 protruding from of the surface of the cathode base 3, so that the through groove 32 is not a continuous through groove, but includes a plurality of sub-groove portions respectively distributed in the ridges 33. After the filament 2 is installed in the through groove 32, a gap is formed between the filament 2 and the surface, between the adjacent ones of the plurality of ridges 33, of the cathode base 3. The gap is capable of dissipating heat. The ridges 33 together with the through grooves 32 and the grid-controlled structure main body 44 securely fixes the filament 2 to the cathode base 3, preventing the filament 2 from loosening or falling off.

In an exemplary embodiment, as shown in FIG. 4, each of the ridges 33 has a rectangular cross section, a spacing between every adjacent ones of the plurality of ridges 33 is constant, and a direction of extension of each of the ridges 33 is perpendicular to the length direction of the cathode base 3. In the embodiment shown in FIG. 4, the number of the ridges 33 is eleven, the lengths of the ridges 33 (the lengths each extending along the width direction of the cathode base 3) are constant or the same, and the widths of two ones of the ridges 33 at both ends of the cathode base 3 are greater than the widths of the remaining ridges 33 between the two ridges.

In order to increase heating efficiency of the filament, in accordance with an embodiment of the disclosed technology, as shown in FIG. 4, a reflective layer 34 is provided on the surface of the cathode base 3 between adjacent two of the ridges 33. The reflective layer 34 can function to reflect well the thermal radiation from the filament. The reflective layer 34 may be made of a metallic nickel layer.

In one embodiment, the grid-controlled structure 4 further includes a plurality of grid-controlled switches 42, each being mounted to an end of a corresponding one of the plurality of through holes of the grid-controlled structure body 44 such that the plurality of grid-controlled switches 42 may control the plurality of hot cathode emission elements 1 respectively. In one embodiment, the number of the grid-controlled switches 42 is equal to the number of the hot cathode emission elements 1 and also to the number of the through holes.

Referring to FIG. 2, FIG. 5 and FIG. 6, according to a still another embodiment of the disclosed technology, the grid-controlled switches 42 each further include a gridding element 421, a Kovar ring 422, a balancer ring 423 and a lead wire 424, and the grid-controlled structure body 44 is provided with a counter groove 441 at an end, away from the hot cathode emission elements 1, of each of the through holes. An inner diameter of the Kovar ring 422 is greater than an inner diameter of each of the through holes, and an outer diameter of the Kovar ring 422 is less than an inner diameter of the recessed groove 441. The Kovar ring 422 is received in the recessed groove 441 such that an end surface (for example, a lower end surface) of the Kovar ring 422 is conformed and jointed to a bottom surface of the recessed groove 441 and an outer wall surface of the Kovar ring 422 is conformed and jointed to an inner wall surface of the recessed groove 441. The gridding element 421 is received in the Kovar ring 422 such that the gridding element 421 is conformed and jointed to the bottom surface of the recessed groove 441. The balancer ring 423 is received in the Kovar ring 422 and the balancer ring 423 abuts against the gridding element 421 to clamp the gridding element 421 between the balancer ring 423 and the bottom surface of the recessed groove 441. The lead wire 424 is connected to the Kovar ring 422. Each gridding element 421 can achieve independent control of a corresponding one of the hot cathode emission elements by a pulse voltage. The grid-controlled structure body 44 may also be made of alumina ceramic. The gridding element 421, the Kovar ring 422, the balancer ring 423 and the lead wire 424 are all made of metal. Specifically, the gridding element 421 is made of molybdenum (Mo), and the Kovar ring 422 and the balancer ring 423 are made of stainless steel. The lead wire 424 are connected to the Kovar ring 422 by way of metallization welding, such as spot welding, such that applying a pulse voltage to the lead wire 424 may effect control of the corresponding electron gun. In the embodiment as shown in FIG. 6, a mounting process of the grid-controlled switch 42 specifically includes: first, the Kovar ring 422, which is connected to a body of the grid-controlled switch 42, is soldered into the recessed groove 441 by way of metallization welding, then the gridding element 421 is placed in the Kovar ring 422 and the balancer ring 423 with a smaller size is used to press against the gridding element 421, subsequently the balancer ring 423 and the Kovar ring 422 are fixedly connected by spot welding, so that the gridding element 421 is fixed to the grid-controlled structure body 44.

In an exemplary embodiment, the grid-controlled structure body 44 is provided with a first lead wire hole 442 matching with the lead wire 424, and the cathode base 3 is provided with a second lead wire hole 31 matching with the lead wire 424. One end of the lead wire 424 is connected to the Kovar ring 422, and the other end sequentially passes through the first lead wire hole 442 and the second lead wire hole 31 to the side of the cathode base 3 facing away from the hot cathode emission elements 1. As shown in FIGS. 2 and 5, the number of the first lead wire holes 442 and the number of the second lead wire holes 31 are the same as the number of the hot cathode emission elements 1, respectively. The first lead wire holes 442 penetrate through the grid-controlled structure 4 along the thickness direction of the grid-controlled structure 4, and the second lead wire holes 31 each are correspondingly disposed in the respective ridges 33 and penetrate through the ridges along the thickness direction of the ridges 33. A process of installing the lead wire 424 is as follows: the lead wire 424 is sequentially passed through the second lead wire hole 31 and the first lead wire hole 442, and then the lead wire 424 is fixedly connected to the Kovar ring 422 by spot welding such that the gridding element 421, the Kovar ring 422, the balancer ring 423, and the lead wire 424 are assembled as an integral piece, and applying a pulse voltage to the lead wire 424 may control passing of the electron beam.

In one embodiment, as shown in FIG. 6, in order to prevent the Kovar ring 422 and the balancer ring 423 from rotating in the circumferential direction, the grid-controlled switch 42 further includes a stop member 425. A first position-limit hole portion and a second position-limit hole portion are provided in pair in the Kovar ring 422 and the balancer ring 423 respectively, in the circumferential direction at a junction or an interface between the Kovar ring 422 and the balancer ring 423, such that the first position-limit hole portion is located at an outer circumference of the Kovar ring 422 and the second position-limit hole portion is located at an inner circumference of the balancer ring 423. The first position-limit hole portion and the second position-limit hole portion that are in pair define a position-limit circular hole and further, the grid-controlled structure body 44 is provided with a mounting hole corresponding to the position-limit circular hole, such that the stop member 425 is able to being inserted into the position-limit circular hole and the mounting hole to limit the Kovar ring 422 and the balancer ring 423. In the embodiment shown in FIG. 6, each grid-controlled switch 42 has four stop members 425, and the four stop members 425 are evenly distributed at the junction or interface between the Kovar ring 422 and the balancer ring 423.

The external grid-controlled hot cathode array electron gun of the disclosure may be provided with increased or decreased number of electron gun arrays as required, can realize splicing multiple sets of electron gun arrays, can flexibly meet the needs of radiation source devices requiring multiple electron sources, and have advantages such as a simple manufacturing process, good consistency, fast startup and long life.

It will be understood by those skilled in the art that the embodiments described above are exemplary and can be modified by those skilled in the art, and the structures described in the various embodiments may be combined freely without conflict in terms of structure or principle.

The accompanying drawings are referred to describe the disclosed technology and however, they are intended to be illustrative of the preferred embodiments of the disclosure, instead of limiting the disclosed technology.

While some embodiments of the present general inventive concept have been shown and described, it will be understood by those of ordinary skill in the art may modify the embodiments without departing away from the present general inventive concept, and the scope is defined by the claims and their equivalents.

What is claimed is:

1. An external grid-controlled hot cathode array electron gun, comprising:

an insulated cathode base;

a filament, the filament being in form of a strip and mounted on a surface of the cathode base;

a plurality of hot cathode emission elements mounted on a surface of the filament facing away from the cathode base; and a grid-controlled structure comprising an insulated grid-controlled structure body and a plurality of through holes provided in the grid-controlled structure body, one side of the grid-controlled structure body abutting against the cathode base so that the filament is held between the grid-controlled structure body and the cathode base, and so that the plurality of hot cathode emission elements on the surface of the filament are inserted into the plurality of through holes, respectively.

2. The external grid-controlled hot cathode array electron gun of claim 1, wherein the grid-controlled structure further comprises a plurality of grid-controlled switches, and each of said plurality of grid controlled switches is mounted to an end of one of the plurality of through holes of the grid-controlled structure body such that the plurality of grid-controlled switches are capable of controlling the plurality of hot cathode emission element respectively.

3. The external grid-controlled hot cathode array electron gun of claim 2, wherein each of the grid-controlled switches further comprises a gridding element, a Kovar ring, and a balancer ring and a lead wire, wherein the grid-controlled structure body is provided with a recessed groove at an end of the through hole away from the hot cathode emission elements, an inner diameter of the Kovar ring is greater than an inner diameter of the through hole, and the Kovar ring is received in the recessed groove such that an end surface of the Kovar ring is conformed and jointed to a bottom surface of the recessed groove and an outer wall surface of the Kovar ring is conformed and jointed to an inner wall surface of the recessed groove, wherein the gridding element is accommodated in the Kovar ring such that the gridding element is conformed and jointed to the bottom surface of the recessed groove, and the balancer ring is received in the Kovar ring and abuts against the gridding element so as to clamp the gridding element between the balancer ring and the bottom surface of the recessed groove, and wherein the lead wire is connected to the Kovar ring.

4. The external grid-controlled hot cathode array electron gun of claim 3, wherein the grid-controlled structure body is provided with a first lead wire hole matching the lead wire and the cathode base is provided with a second lead wire hole matching the lead wire, one end of the lead wire is connected to the Kovar ring, and the other end of the lead wire sequentially passes through the first lead wire hole and the second lead wire hole and extends to a side of the cathode base facing away from the hot cathode emission elements.

5. The external grid-controlled hot cathode array electron gun of claim 3, wherein each of the grid-controlled switches further comprises a stop member, wherein the Kovar ring and the balancer ring are respectively provided with a first position-limit hole portion and a second position-limit hole portion, which are disposed in pair, in a circumferential direction thereof at a junction between the Kovar ring and the balancer ring, the first position-limit hole portion is located at an inner circumference of the Kovar ring and the second position-limit hole portion is located at an outer circumference of the balancer ring, and the first position-limit hole portion and the second position-limit hole portion, which are disposed in a pair, together define a position-limit circular hole, and wherein the grid-controlled structure main body is provided with a mounting hole corresponding to the position-limit circular hole, so that the stop member is inserted into the position-limit circular hole and the mounting hole to fix the Kovar ring and the balancer ring.

6. The external grid-controlled hot cathode array electron gun of claim 1, wherein the cathode base comprises a through groove, and the filament is mounted to the through groove, a width of the through groove is not less than a width of the filament, and a depth of the through groove is greater than a thickness of the filament, and wherein the grid-controlled structure body includes a projection that cooperates with the through groove to clamp the filament therebetween.

7. The external grid-controlled hot cathode array electron gun of claim 6, wherein the cathode base comprises a plurality of ridges, a space is defined between every adjacent two of the ridges and the through groove is formed on a top side of each of the plurality of ridges.

8. The external grid-controlled hot cathode array electron gun of claim 7, wherein a reflective layer is provided, between adjacent two of the ridges, on a surface of the cathode base.

9. The external grid-controlled hot cathode array electron gun of claim 1, wherein the filament is in a shape of a 冂, and includes a filament body portion sandwiched between the cathode base and the grid-controlled structure body and a filament folded portion extending along two end faces of the cathode base, the two end faces of the cathode base being perpendicular to the surface of the cathode base on which the filament is mounted.

10. The external grid-controlled hot cathode array electron gun of claim 1, wherein the filament has a width ranged from 1 mm to 2 mm and a thickness ranged from 0.03 mm-0.05 mm.

* * * * *